United States Patent [19]

Odabashian

[11] Patent Number: 4,958,735

[45] Date of Patent: Sep. 25, 1990

[54] EASY OPEN, HEMETICALLY SEALED, DISPLAY PACKAGE MADE FROM HEAT SHRINKABLE FILM

[75] Inventor: Robert A. Odabashian, Greer, S.C.

[73] Assignee: W. R. Grace & Co.-Conn., Duncan, S.C.

[21] Appl. No.: 749,961

[22] Filed: Jun. 28, 1985

[51] Int. Cl.[5] ..... B65D 65/00

[52] U.S. Cl. ..... 206/497; 206/45.33; 206/471; 206/610

[58] Field of Search ..... 206/497, 45.33, 471, 206/484, 45.34, 610, 620

[56] References Cited

U.S. PATENT DOCUMENTS

| | | | |
|---|---|---|---|
| 2,622,986 | 12/1952 | Snyder et al. | 206/620 X |
| 3,516,537 | 6/1970 | Dreyfus et al. . | |
| 3,641,732 | 2/1972 | Fujio . | |
| 3,679,048 | 7/1972 | Fujio . | |
| 3,741,253 | 6/1973 | Brax et al. | 138/137 |
| 3,863,837 | 2/1975 | Spiegel et al. | 206/497 X |
| 3,889,870 | 6/1975 | Bender . | |
| 3,920,123 | 11/1975 | Martelli | 206/497 |
| 4,000,325 | 12/1976 | Rausing . | |
| 4,249,659 | 2/1981 | Schirmer . | |

*Primary Examiner*—Bryon P. Gehman

*Attorney, Agent, or Firm*—John J. Toney; William D. Lee, Jr.; Jennifer L. Skord

[57] ABSTRACT

An easy open, hermetically sealed, display package made from a single sheet of thermoplastic, gas barrier, heat shrinkable film is provided. The sheet is folded to form one end of the package, the fold being spaced apart from a seal parallel to the fold line with the material between the seal and the fold line being unshrunken and the remainder of the material being shrunk around the product and sealed on all sides. A unshrunken strip of plastic material having a line of weakness is adhered to the unshrunken portion which is also provided with a line of weakness which also corresponds to the line of weakness in the unshrunken strip. The material on both sides of the line of weakness serves as tear tabs.

1 Claim, 4 Drawing Sheets

EASY OPEN, HEMETICALLY SEALED, DISPLAY PACKAGE MADE FROM HEAT SHRINKABLE FILM

FIELD OF THE INVENTION

This invention relates to a display package formed from heat shrinkable, thermoplastic film. In particular, this invention relates to a package formed from thermoplastic film wherein the products packaged are food items and the package is provided with "easy-open" means.

BACKGROUND OF THE INVENTION

Food and other items are frequently packaged for retail purposes in shrinkable film that is then shrunk around the goods. The film may initially be in the form of a bag in which event the bag is open at one end to permit the insertion of the goods or a product and is then sealed and shrunk around the product. It is often desirable to be able to provide the bag with a means to easily open it, with a surface area upon which a label or printed matter may be placed, and with means for hanging the package if that is desired. It is therefore, a general object of this invention to provide such a package.

Representative bags and containers employing shrink film features are found in the following patents:

In U.S. Pat. No. 3,516,537 which was issued on June 23, 1972 to Robert L. Dreyfus et al there is disclosed a package in which a plastic container having shrunken film walls and a product in the container is constructed so that film walls extending beyond the closure seal of the package form a flange section or skirt which is provided with a notch for the purpose of providing a tear tab. In U.S. Pat. No. 4,249,659 which was issued on Feb. 10, 1981 to Henry G. Schirmer there is disclosed a package and method of producing the package by forming a pocket in a central portion of a sheet of wrapping material, which may be shrinkable thermoplastic film, placing a product within the pocket, folding the flat portions of the film into face-to-face contact and bonding the flat or flange portions together. In U.S. Pat. No. 4,000,325 which issued on Dec. 28, 1976, to Gad A. Rausing there is disclosed a pressurized plastic container formed with transverse seals with a flattened area between the sealing zones. U.S. Pat. No. 3,641,732 which issued on Feb. 15, 1972, to Masaaki Fujio discloses a package in which a product is enclosed in plastic film which is heat shrinkable and which provides a tear tab protruding sideways from the package. Another package, shown in a patent to the same inventor, is disclosed in U.S. Pat. No. 3,679,048 which issued on July 25, 1972. In U.S. Pat. No. 3,889,870 which issued on June 17, 1975, to Hugo Bender a welded bag of stretched polyester film is shown in which the edge region of the bottom weld is post-stretched. Accordingly, another object of the present invention is to provide a package which is an improvement over prior shrink wrap packages which are used to display products to retail purchasers.

A package employing shrink film to make a hang bag is disclosed in U.S. Patent Application Ser. No. 734,375 filed by Wood et al on May 15, 1985 and assigned to the assignee this application. A further object of the present invention is to provide a package which, optionally, may be converted to a hang bag.

Another object of the present invention is to provide tear tabs which are immediately obvious to the consumer who is about to open the package. In many packages on the market today the opening means are obscured by printing of other subject matter on the package or the opening means consists of hard-to-separate overlying pieces of film. An object of the present invention is to overcome these defencies.

The objects of the present invention are achieved by the novel package which is described in greater detail below.

SUMMARY OF THE INVENTION

It has been surprisingly discovered that a display package comprising: a product; a receptacle formed from a single sheet of heat shrinkable, flexible heat sealable thermoplastic sheet material in which the receptacle comprises a shrunken portion wherein the sheet material is shrunken and conforms generally to the shape of the product; and an unshrunken portion separated from the shrunken portion by a heat seal or by the entire unshrunken portion being heat sealed to itself. Grippable tabs are provided by a score line or line of weakness in the unshrunken portion. The display package may be further provided with means to hang the package from a peg board or the like.

In another aspect of the present invention, the package described above includes a strip of non-shrinkable thermoplastic material adhered to the unshrunken portion of the receptacle to provide tab extensions, the non-shrinkable strip being provided with a line of weakness dividing the strip into two manually grippable sections that serve as tear tabs to open the package.

In yet another aspect, the present invention is a method of providing a package having shrunken and unshrunken portions within the same sheet of heat-shrinkable film wherein a product can be hermetically enclosed within the shrunken portion.

Further aspects of the present invention will become apparent from the disclosure which follows and the specification concludes with claims particularly pointing out and distinctly claiming subject matter which is regarded as my invention.

DESCRIPTION OF THE DRAWINGS

The invention, as to organization and method of operation, together with other objects and advantages, may best be understood by reference to the following description when taken in conjunction with the accompanying drawings in which.

DESCRIPTION OF A PREFERRED EMBODIMENT

Figure 1:
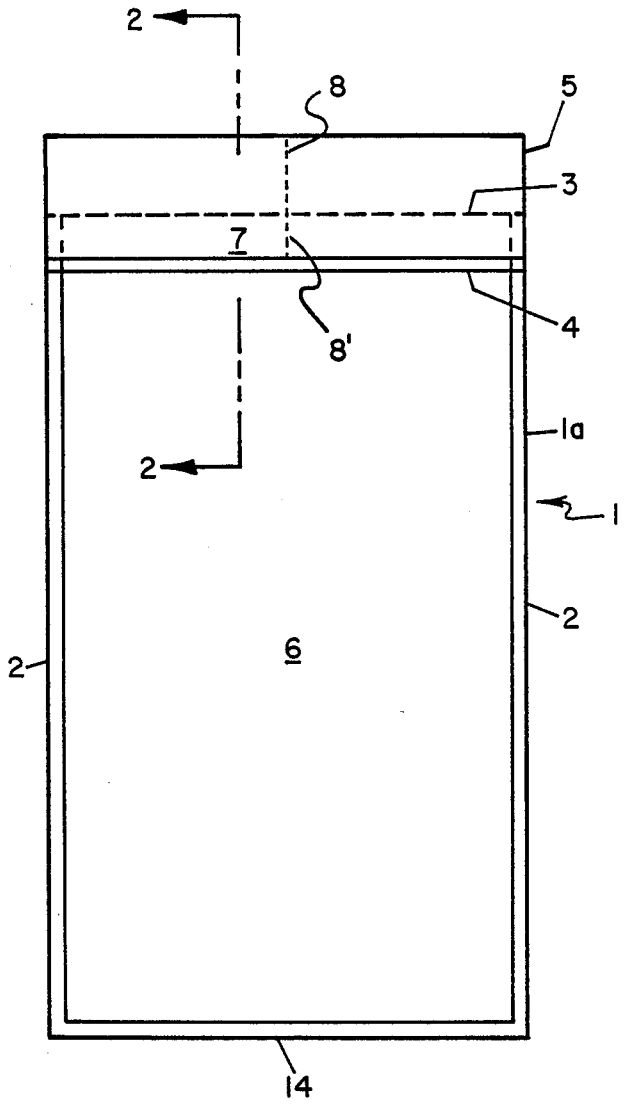
FIG. 1 is a plan view of a flattened, unfilled and unshrunk receptacle made from a single sheet of heat shrinkable, heat sealable, thermoplastic material combined with an non-shrink strip.

Turning first to FIG. 1 a bag or receptacle 1 is shown which is formed from a single sheet of heat sealable, thermoplastic sheet material. The sheet is folded along fold line 3 and the fold can be further appreciated by viewing FIGS. 2 and 3. This sheet which is folded over is sealed along its edges or sides by side seals 2 which are heat seals applied under heat and pressure. Spaced apart from the fold line 3 which is shown in dotted line in FIG. 1 is bottom or divider seal line 4 which is preferably parallel to the fold and hermetically seals the bottom of the bag and divides the bag into a shrinkable portion 6 which will be shrunk and a shrinkable portion 7 which will not be shrunk. The seal line 4 defines the region of the unshrunken portion. A narrow seal across the bag may be provided or the seal can extend from seal line 4 to the fold line 3 in which instance the walls of the bag have been heat sealed together in this region. This region can be provided with perforations 8' to provide a line of weakness along which an opening tear may be initiated.

A non-shrinkable strip 5 is adhered to the portion 7 and the strip 5 is provided with a line of weakness which can be a score line or is preferably a line of perforations 8. The strip 5 provides tear tab extensions 11 and 12.

A very suitable heat shrinkable and heat sealable material is a multi-layer, flexible film laminate having an outer layer of ethylene vinyl acetate copolymer that has been cross-linked and a saran barrier layer sandwiched between the cross-linked layer and another outer layer of ethylene vinyl acetate copolymer that is disclosed and described in U.S. Pat. No. 3,741,253 which issued on June 26, 1973, to Harri J. Brax et al and which patent is incorporated herein by reference. Other monolayer and multi-layer shrink films are suitable for use in the present invention.

The material for the non-shrinkable strip is preferably a relatively thick, e.g., up to 5 mils thick, polyethylene or ethylene vinyl acetate copolymer film which has not been oriented to make it heat shrinkable. A number of commercially available adhesives which are well known to those skilled in the art can be used to apply the non-shrinkable strip to the portion 7 of the bag. In addition, a thermal seal may be used in conjunction with the adhesive or alone. If a thermal seal alone is used, the necessity for adhesive is eliminated.

Figure 4:
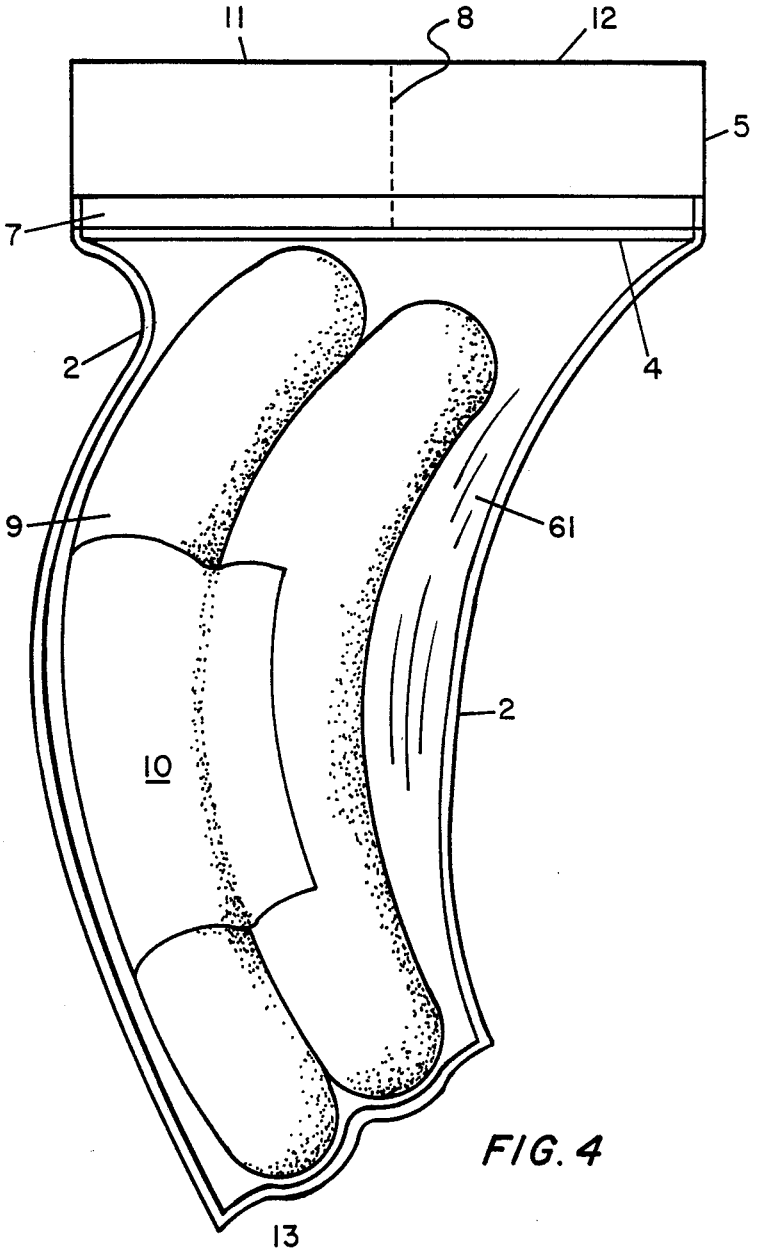
FIG. 4 shows an embodiment of the finished package for display according to one embodiment of the present invention.

In FIG. 4 a package which is one preferred embodiment of the present invention is shown. In the package a product such as frankfurters is enclosed in the shrinkable portion 6 which is now shrunken portion 61 of the bag or receptacle which is shown in FIG. 1. A label 10 can be also provided inside or outside the package. The score line or line of weakness 8 which preferably is a line of perforations divides the non-shrinkable strip 5 into two sections 11 and 12 which can be manually gripped, one section with one hand and the other with the other hand, and pulled in opposite directions to initiate a tear down line 8 which will open the package.

In FIG. 4, the receptacle portion 61 is shrunken tightly around the frankfurters. The portion 7 has not shrunk and the two portions 61 and 7 are separated by seal 4 located at the opposite end of the package from seal 13 which is the closure seal. The package is evacuated after the product 9 is placed therein and subsequently sealed by seal 13. Thus, air is removed to preserve the product and also to prevent ballooning of the package by entrapped air when the film portion 6 is shrunk around the product 9.

Figure 2:
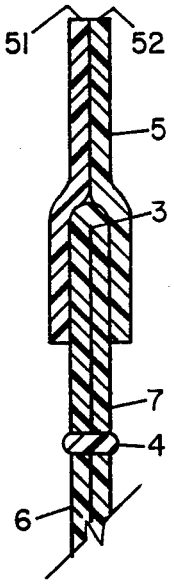
FIG. 2 is a section looking along lines 2—2 of FIG. 3 showing one embodiment of a present invention.
Figure 3:
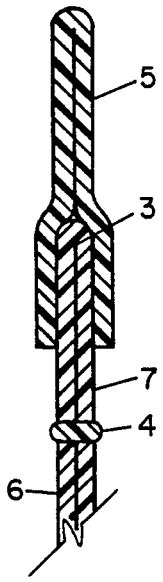
FIG. 3 is the same section as shown in FIG. 2 but showing another embodiment of the present invention.

Looking now at FIGS. 2 and 3, alternate embodiments for the non-shrink strip are shown. In both of these embodiments the non-shrinkable strip 5 or tab extension 5 is adhered to both sides of the folded receptacle unshrunk portion 7 which is shown separated from the portion 6 by seal 4. In the embodiment in FIG. 2 the non-shrinkable strip 5 comprises two sections 51 and 52 which are adhered together. In order to provide the "tear open" features of the invention, it is important that the strip or strips be adhered to both sides of the receptacle fold since, in the "tear open" process force needs to be applied to both sides of the bag in the unshrunken or tab area. Having strip 7 adhered on both sides accomplishes this. For example, in FIG. 3 strip 5 is folded over and adhered to both sides of unshrunken portion 7.

One embodiment of a method of making the package according to the present invention requires folding a piece of sheet material la as shown in FIG. 1 along a fold line 3 to form the bottom of the bag and then applying three seals, namely, the two side seals 2 and the bottom seal 4 which is spaced apart from the fold line 3. The bag material may be the preferred multi-layer film material mentioned above. A bag is now formed with an open mouth 14. Next, the portion 7 is rendered unshrinkable by running it through the nip of a pair of opposed, heated, endless bands. The opposed bands are preferably stainless steel or fiberglass and are coated with Teflon. Each band is mounted on a pair of spaced apart, driven rollers and the bands are heated by heaters mounted between the rollers in sliding contact with the bands. One band is aligned above the other so that the lower run of the upper band and upper run of the lower band contact portion 7. In this manner portion 7 is "annealed" or "stress relieved " so that it will not tend to shrink and the walls of portion 7 will tend to adhere to each other thus giving the portion 7 added stiffness.

In another embodiment, the making of bottom seal 4 as a separate step is eliminated and the heat and pressure of the bands is relied upon to seal the bag walls of portion 7 together thus using only one seal at the bottom of the bag.

The next step is to apply the non-shrinkable strip by adhering it to portion 7 of the bag so the result will be as represented by FIG. 3. As an alternate method, this portion of the bag and strip, that is, the portion which is represented by that portion above seal 4 in FIG. 3, can be gripped between clamps which extend the entire width of the bag. These clamps are preferably cooled and can remain in place during the shrinking of portion 6.

The product is next inserted into a bag in which portion 7 has been annealed or is clamped and the bag is evacuated and heat sealed. This clamping, evacuation, and sealing can take place within a vacuum chamber or it can be performed outside of it using a nozzle and clamp. These methods are well known to those skilled in the art to provide a hermetically sealed package. At this point the product is within the bag, the bag is sealed at its mouth 14 by seal 13 which is also preferably a heat seal and the interior of bag portion 6 has been evacuated. Now, as the clamp holds the unshrunken portion of the bag, the portion to be shrunken, namely portion 6, is dipped in a hot water bath for a short period of time to shrink the shrinkable portion tightly around the product and into conforming relationship therewith so that a package as shown in FIG. 4 results when the clamps are removed. Alternately, when the portion 7 has been annealed, the entire bag may be placed in a hot water bath.

Additional labeling material may be applied to the strip 5 or holes may be put in strip 5 so that the package can be hung from a display board. The perforations 8 may be punched at this time.

Figure 5:
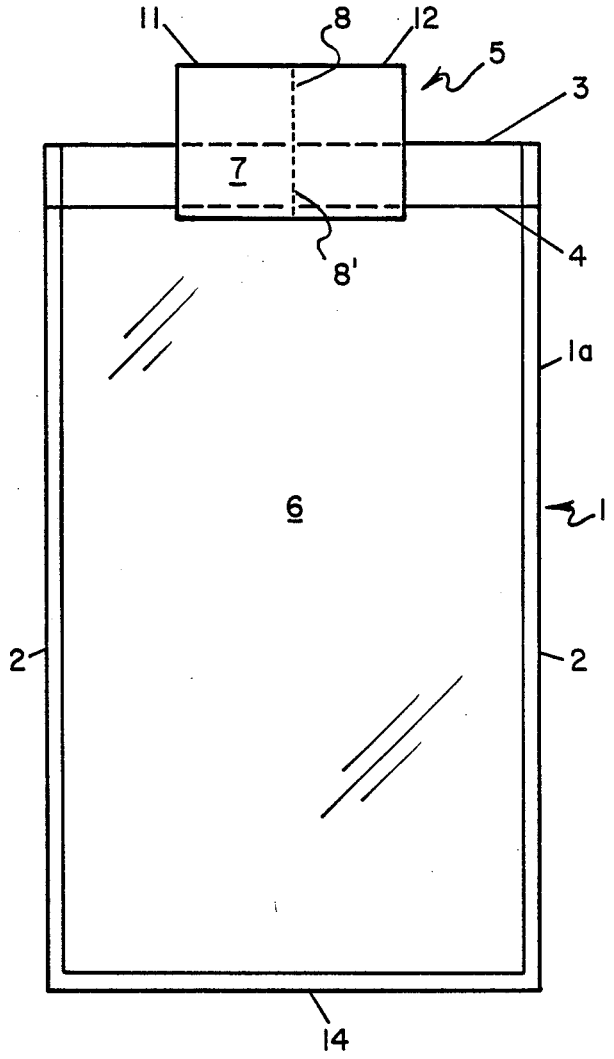
FIG. 5 is a plan view, similar to FIG. 1, showing an alternate non-shrink strip in combination with a heat shrinkable receptacle.
Figure 6:
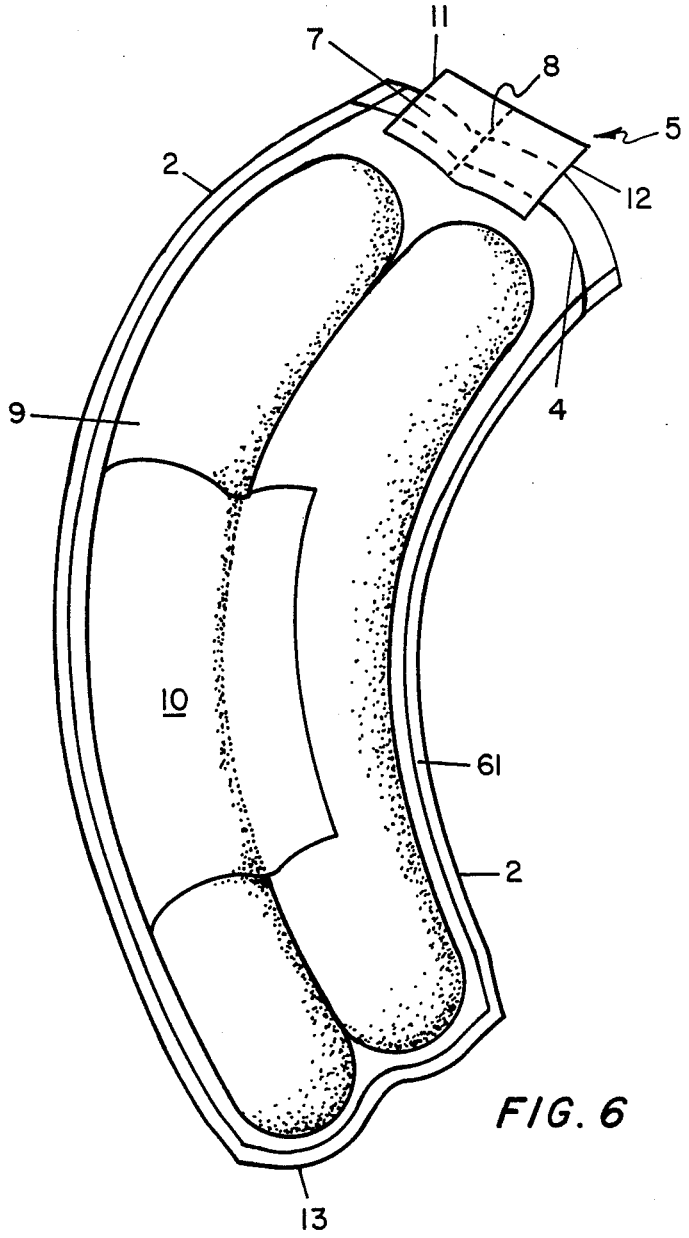
FIG. 6 shows an alternate embodiment of the present invention

Turning now to FIGS. 5 and 6 an alternate embodiment is disclosed. Rather than being coextensive with the width of the bag and covering completely fold line 3, non-shrinkable strip 5 covers only the central region of the unshrunken portion 7. When shrunk, the shrink forces in portion 61 will tend to cause portion 7 and strip 5 to "bow" slightly. In this embodiment it is preferred that the unshrunken portion 7 of the bag be sealed to itself so that the seal line 4 marks the beginning of a large seal area which is designated generally as 7.

While in accordance with the patent statutes I have described what at present is considered to be the preferred embodiment of my invention, it will be obvious to us skilled in the art the various changes and modifications may be made therein without departing from the invention and, I, therefore, aim in the following claims to cover all of the equivalent variations as fall within two spirit and scope of this invention.

I claim:

1. A display package comprising:

(a) a product;

(b) a receptacle formed from a single sheet of heat-shrinkable, single-fold, flexible, heat sealable, gas barrier, thermoplastic sheet material, said receptacle comprising:

1. a shrunken portion, wherein the sheet material is shrunken and conforms generally and closely to the shape of the product;

2. an unshrunken portion having a fold line which forms one end of the receptacle, and the unshrunken portion being separated from the shrunken portion by a heat seal parallel to and spaced apart from the fold line and having a line of weakness perpendicular to the seal along which an opening tear may be initiated;

3. the sides of said receptacle being formed by heat seals which seal the respective side edges of the sheet together; and

4. the mouth of the receptacle being closed by a heat seal thereby hermetically enclosing the product within the shrunken portion; and (c) a strip of non-shrinkable thermoplastic material adhered to said unshrunken portion, said strip having a line of weakness corresponding to the line of weakness in the unshrunken portion of the receptacle and dividing said strip into two manually grippable sections that serve as tear tabs to open said package.

* * * * *